US012270210B2

(12) United States Patent
Chapman

(10) Patent No.: US 12,270,210 B2
(45) Date of Patent: Apr. 8, 2025

(54) DECK BOARD

(71) Applicant: Wesley Raymond Chapman, Johannesburg (ZA)

(72) Inventor: Wesley Raymond Chapman, Johannesburg (ZA)

( * ) Notice: Subject to any disclaimer, the term of this patent is extended or adjusted under 35 U.S.C. 154(b) by 101 days.

(21) Appl. No.: 17/744,370

(22) Filed: May 13, 2022

(65) Prior Publication Data

US 2022/0268032 A1 Aug. 25, 2022

Related U.S. Application Data

(63) Continuation-in-part of application No. 16/645,435, filed as application No. PCT/IB2018/056790 on Sep. 6, 2018, now abandoned.

(51) Int. Cl.

| | |
|---|---|
| ***E04F 15/02*** | (2006.01) |
| ***E04B 1/00*** | (2006.01) |
| ***E04F 15/10*** | (2006.01) |

(52) U.S. Cl.

CPC ..... *E04F 15/02183* (2013.01); *E04B 1/003* (2013.01); *E04F 15/02161* (2013.01); *E04F 15/102* (2013.01); *E04F 2203/04* (2013.01)

(58) Field of Classification Search

CPC ..... E04F 15/02183; E04F 1/003; E04F 15/02161; E04F 15/102; E04F 2203/04

See application file for complete search history.

(56) References Cited

U.S. PATENT DOCUMENTS

| | | | | |
|---|---|---|---|---|
| 4,758,128 | A | 7/1988 | Law | |
| 5,228,253 | A | 7/1993 | Wattelez | |
| 7,021,012 | B2 | 4/2006 | Zeng et al. | |
| 7,406,801 | B2 | 8/2008 | Zeng et al. | |
| 7,415,801 | B2 | 8/2008 | Zeng et al. | |
| 2005/0210774 | A1* | 9/2005 | Zeng | E04F 15/02194 52/177 |
| 2005/0284058 | A1 | 12/2005 | Zeng et al. | |
| 2013/0086864 | A1 | 4/2013 | Marriott | |
| 2016/0152410 | A1 | 6/2016 | Adams | |
| 2020/0217085 | A1* | 7/2020 | Chapman | E04F 15/02161 |
| 2022/0268032 | A1* | 8/2022 | Chapman | E04F 15/02161 |

* cited by examiner

*Primary Examiner* — Andrew J Triggs

(74) *Attorney, Agent, or Firm* — Sheppard, Mullin, Richter & Hampton LLP; Xin Xie

(57) ABSTRACT

This invention relates to a deck board and more particularly, to a reduced material deck board. In accordance with this invention there is provided a deck board comprising an operatively upper board section having at least one operatively downwardly depending support leg terminating in at least one flange, an underside of the flange having a concave surface.

16 Claims, 7 Drawing Sheets

DECK BOARD

CROSS REFERENCE TO RELATED APPLICATIONS

This application is a continuation-in-part of U.S. application Ser. No. 16/645,435, filed on Mar. 6, 2020, which is the U.S. National Stage of International Application No. PCT/IB2018/056790, filed on Sep. 6, 2018, which claims priority to South Africa Application No. 2017/01869, filed on Sep. 6, 2017, the content of each of which is hereby incorporated by reference in its entirety.

FIELD OF THE INVENTION

This invention relates to a deck board and more particularly, to a reduced material deck board.

BACKGROUND TO THE INVENTION

Hollow deck boards or reduced material deck boards are well-known and widely used. These deck boards are lighter and cheaper to manufacture, as a result of using less material.

A disadvantage of hollow deck boards having square or round bores are that they may become waterlogged. The water thus collected inside the deck board damages the material due to temperature fluctuations and may cause rot inside the deck board.

Some deck boards do not have bores therein but have open, reduced material sections.

NewTechWood alleges the following on their website at http://www.newtechwood.com:

"Hollow vs. Solid core composite deck boards

What are the Pros and Cons with hollow composite deck boards vs. solid core composite deck boards?

Most composite deck board manufacturers in the US offer only solid core boards. The main reason is due to the speed and ease in manufacturing those boards vs. hollow boards. It is much easier and faster to extrude solid composite boards than it is hollow. Most manufacturers don't want to deal with the difficulty or expend the extra time to manufacture hollow boards.

So why does NewTechWood offer a hollow board?

NewTechWood is one of the only companies in the US that offers a hollow board, and we do so for a couple of reasons. Offering a hollow board cuts down the weight of 16' board by as much as 32% or 10 pounds when compared to a solid board. This makes them easier to work with and if you're retrofitting an older deck where the structure is sound and you just want to replace the surface boards, the hollow boards create less stress on that older substructure than do solid boards.

What's the Difference in the Strength of the Hollow Boards Compared to the Solid Boards?

Many people think that because the board is hollow it must be significantly weaker than a solid board. The fact is the arch structure of the voids in NewTechWood's hollow board makes up for the use of less material in the core. The industry standard for maximum span as set by the International Code Council for the US is 16" on center. That means each joist in the substructure must measure 16" from the center of one joist to the center of the adjacent joist. Most installation guides for manufacturers of solid boards require a span of 16" on center or less. The hollow boards offered by NewTechWood are also rated by the ICC at 16" on center. That means NewTechWood's UltraShield hollow boards will hold your hot tub just the same as the solid boards. NewTechWood also offers solid core boards as well. Those are recommended for stairs and other installations where you don't want the grooves for hidden fasteners to show, or if you're not installing a fascia board, and we also recommend them for commercial installations.

What's the Difference is Price?

This is perhaps the most attractive reason for using NewTechWood UltraShield hollow boards over solid. Because the board is hollow, less material is used in the manufacturing process. This enables NewTechWood to pass the savings along to the consumer. The cost savings can be huge, as much as 22%.

For example, if you build a 12'×16' deck, you save $363.00 on the cost of materials. That's a significant amount for you to spend on other priorities for your home."

United States patent application number US20030154662 A1, entitled "Hollow profile decking system comprising plank and anchor using anchor flange construction" in the name of Andersen Corporation, discloses:

A decking system, decking components and an installed deck for use on a support structure. The decking system comprises hollow profile planking units having anchor flanges on opposite edges that cooperate with an anchor structure to form a deck or platform. The flanges and the anchor units are shaped and configured to closely interact and form an installed platform structure. The planks comprise an extruded thermoplastic wood fiber composite having an internal structure sufficient to withstand installation, engineering forces placed on the installed platform, weathering and use. The anchor structures have a shape that conforms to the anchor flanges on the decking profiles to hold the deck in place.

This patent application includes the following drawing in FIG. 9 showing a cross-section of the hollow profile planking unit. It is clear that water can get trapped in openings or bores 46, as illustrated in FIG. 9.

South African provisional patent application number 2016/05995 in the name of Eva-Last Distributors (Pty) Ltd discloses a reduced material deck board having an arched underside. The arches are cut into the deck board, which would otherwise be solid, thus reducing the amount of material used. This provisional patent application is included herein, its entirety, by way of reference.

OBJECT OF THE INVENTION

It is an object of this invention to provide a deck board which will, at least partially, alleviate the above-mentioned difficulty.

SUMMARY OF INVENTION

In accordance with this invention there is provided a deck board comprising an operatively upper board section having at least one operatively downwardly depending support leg terminating in at least one flange, an underside of the flange having a concave surface.

There is provided for an underside of the upper board section to have a concave surface.

A yet further feature of the invention provides for two flanges to extend transversely away from opposite sides of a lower end of the leg.

There is also provided for anti-slip formations to be located in or on an upper surface of the upper board section.

The anti-slip formations may be a number of parallel, elongate grooves or parallel elongate protrusions or any other convenient anti-slip formation.

This invention extends to a deck board comprising an elongate body which, in cross section, has a number of substantially I-beam shaped sections with operatively horizontal upper or head sections connected to each other and lower operatively horizontally extending foot sections being shorter in length than the head sections so that their free ends are spaced apart.

A central connecting section of the I-beam connects the upper and lower sections to complete the I-beam shape.

An underside of the foot section is concave.

An underside of the connected head sections is concave.

Upper surfaces of the foot sections are substantially operatively horizontal.

There is provided for the deck board to be extruded.

There is provided for the deck board to manufactured from a composite material.

There is provided for the deck board to be extruded from a filled thermoplastic polymer material.

There is provided for the deck board to be extruded from a wood plastic composite material.

There is provided for the decking board to have a wall thickness of at least 7 mm.

There is further provided for the deck board to be used for outdoor decking.

These and other features are described in more detail below.

BRIEF DESCRIPTION OF THE DRAWINGS

One embodiment of the invention is described below, by way of example only, and with reference to the drawings in which.

DETAILED DESCRIPTION OF THE DRAWINGS

Figure 1:
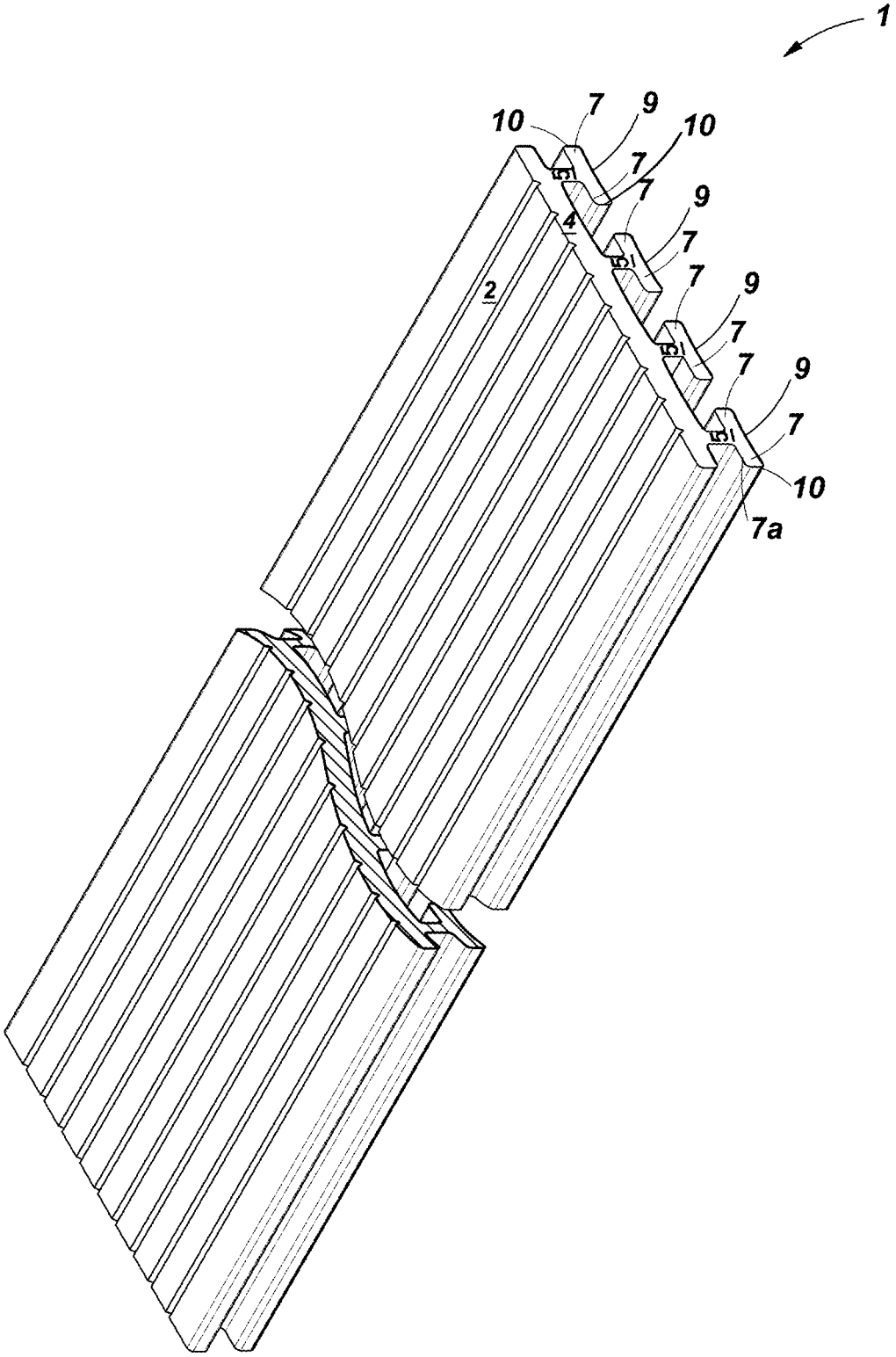
FIG. 1 shows an upper perspective view of a deck board in accordance with the invention.
Figure 2:
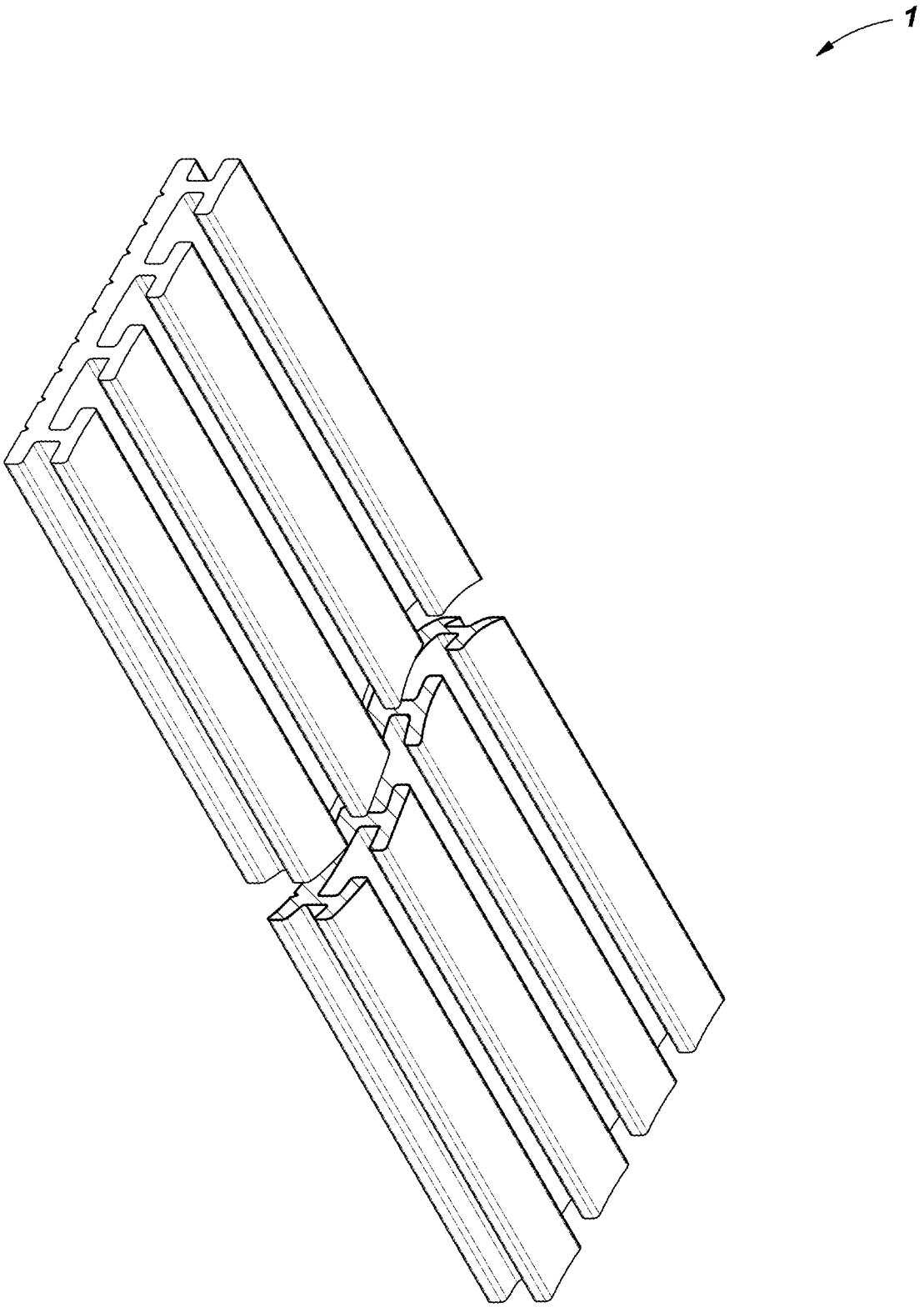
FIG. 2 shows an underside perspective view of the deck board FIG. 1.
Figure 3:
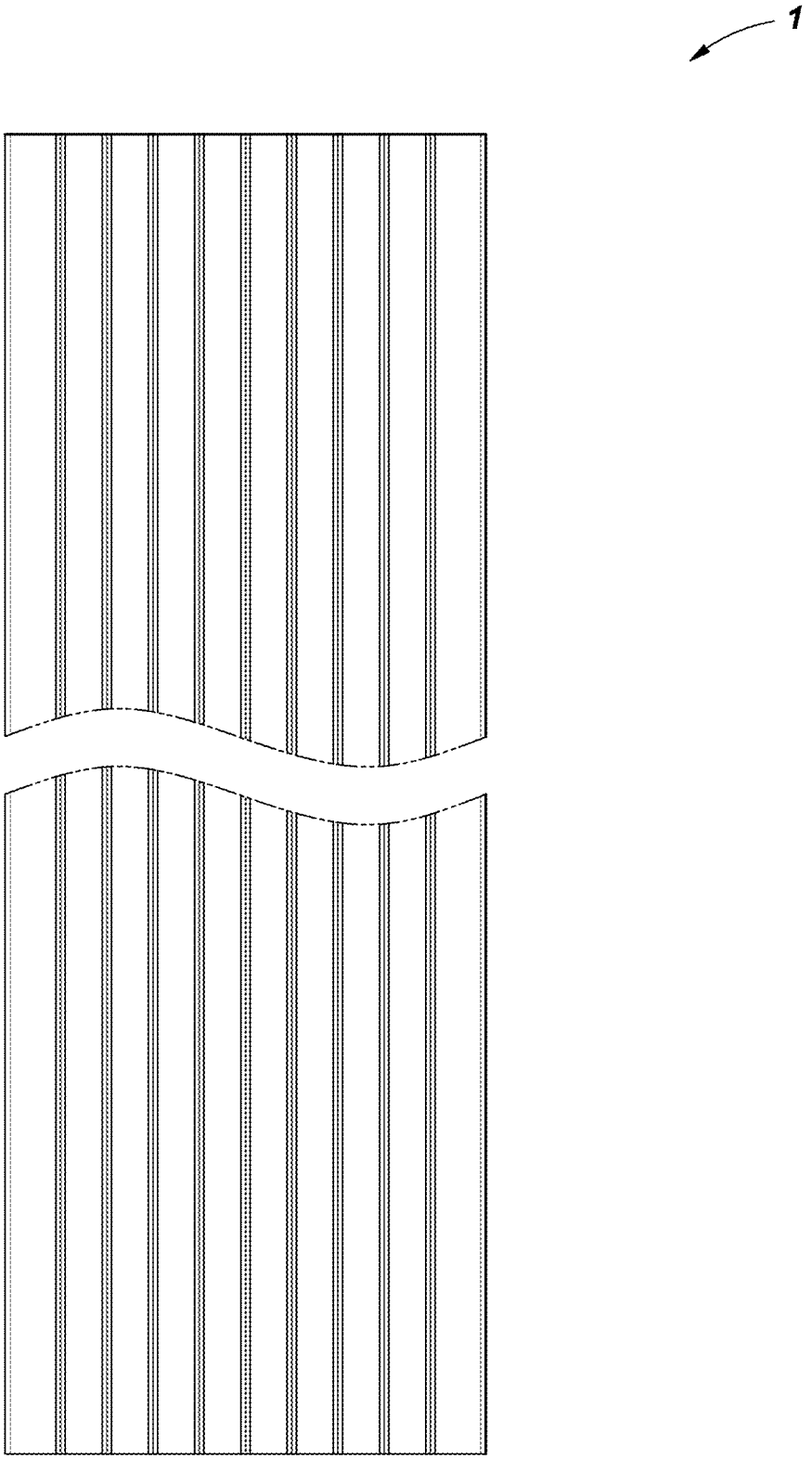
FIG. 3 shows a plan view of the deck board of FIGS. 1 and 2.
Figure 4:
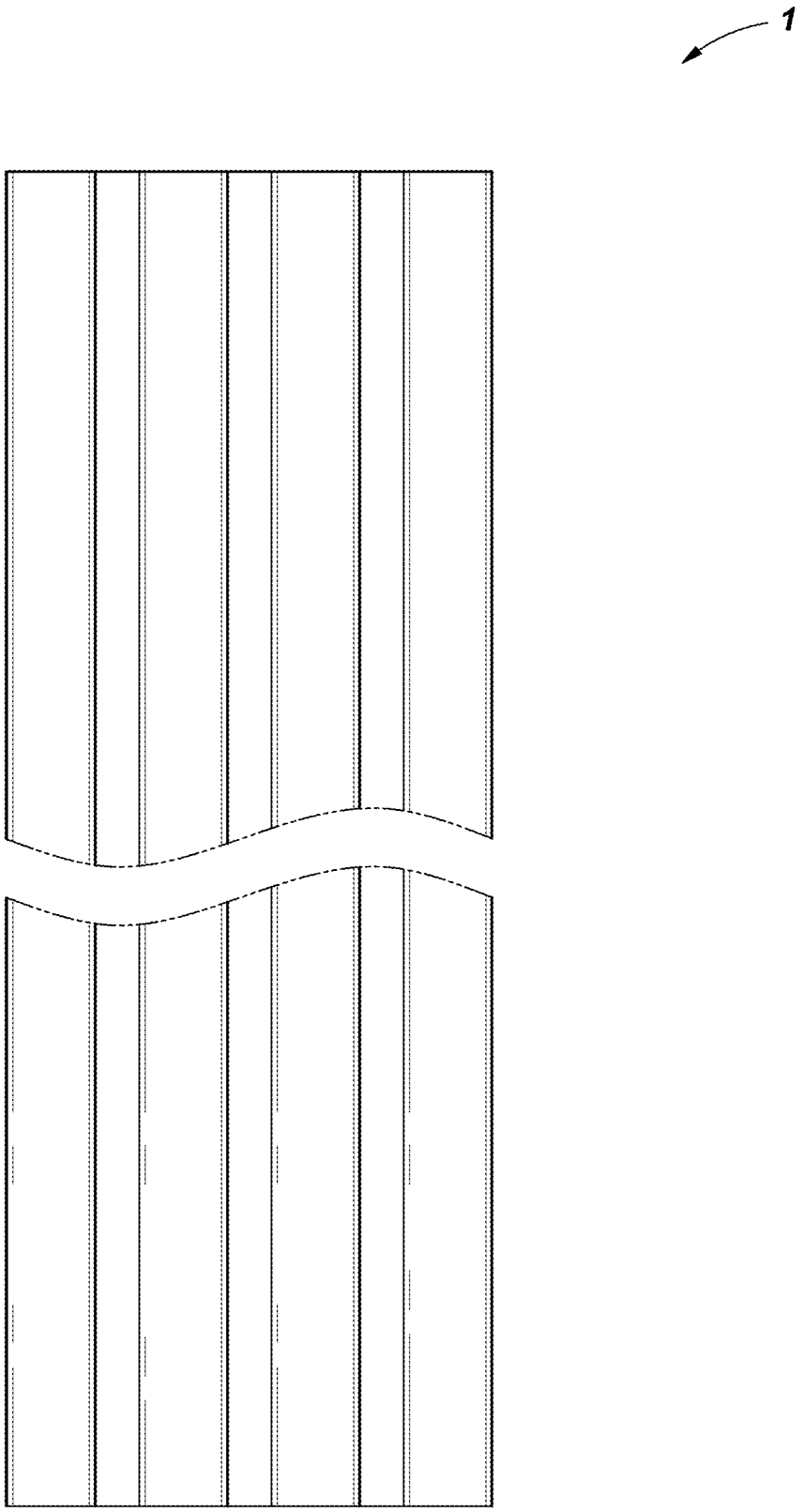
FIG. 4 shows a bottom view of the deck board of FIGS. 1 to 3.
Figure 5:
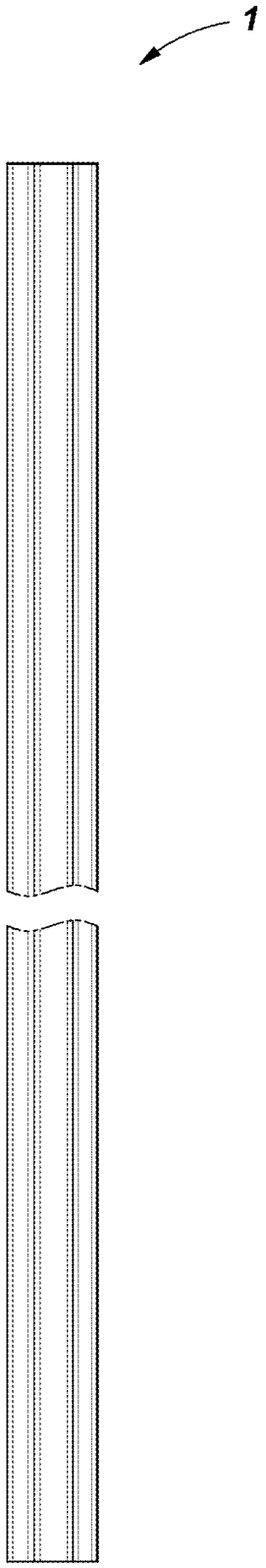
FIG. 5 shows a left side view of the deck board of FIGS. 1 to 4.
Figure 6:
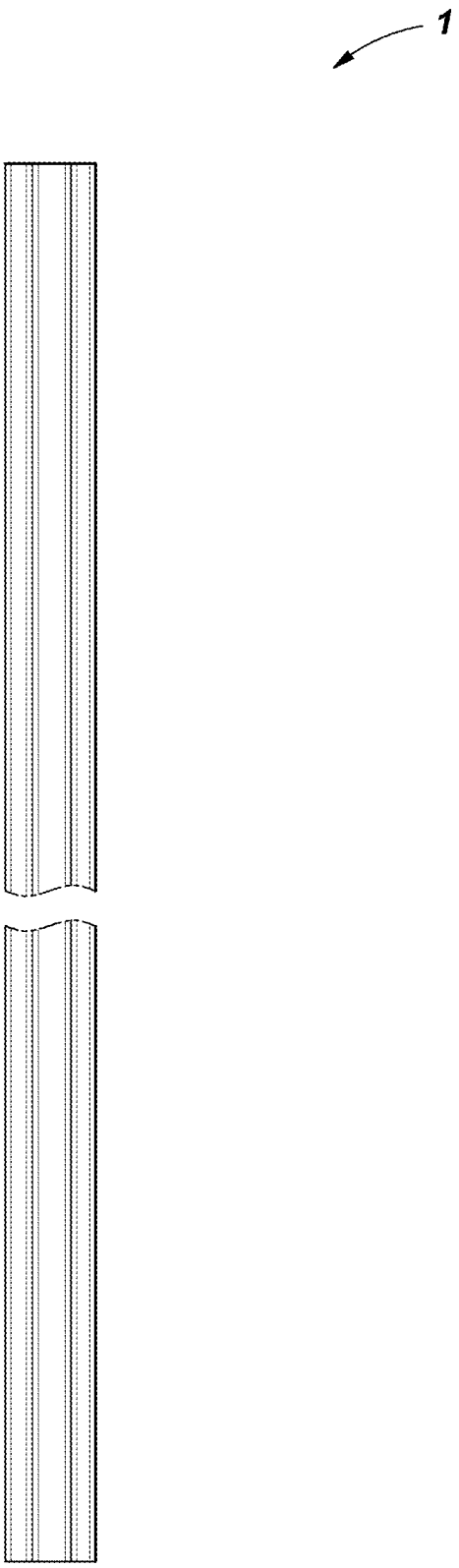
FIG. 6 shows a right-side view of the deck board of FIGS. 1 to 5.
Figure 7:
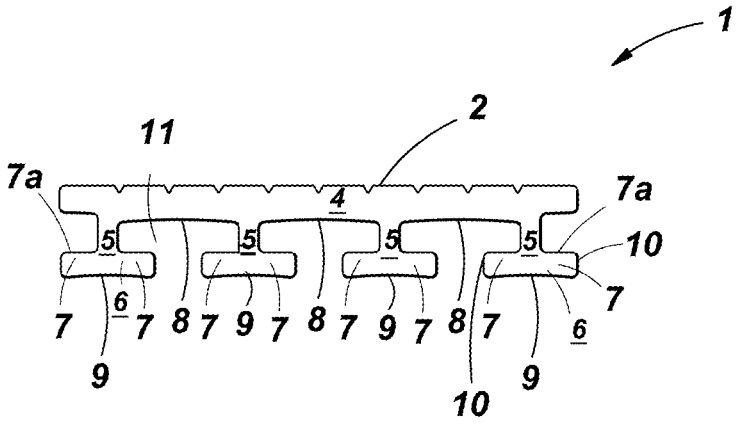
FIG. 7 shows a front-end view of the deck board of FIGS. 1 to 6.
Figure 8:
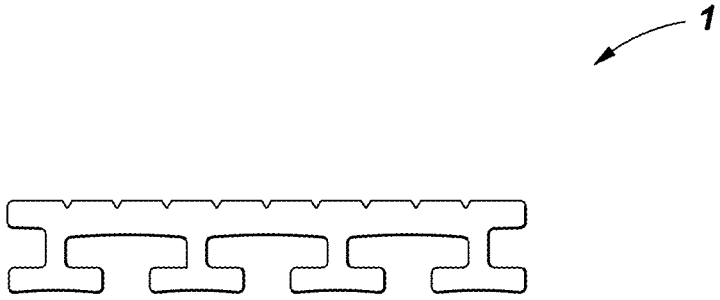
FIG. 8 shows a rear end view of the deck board of FIGS. 1 to 7.
Figure 9:
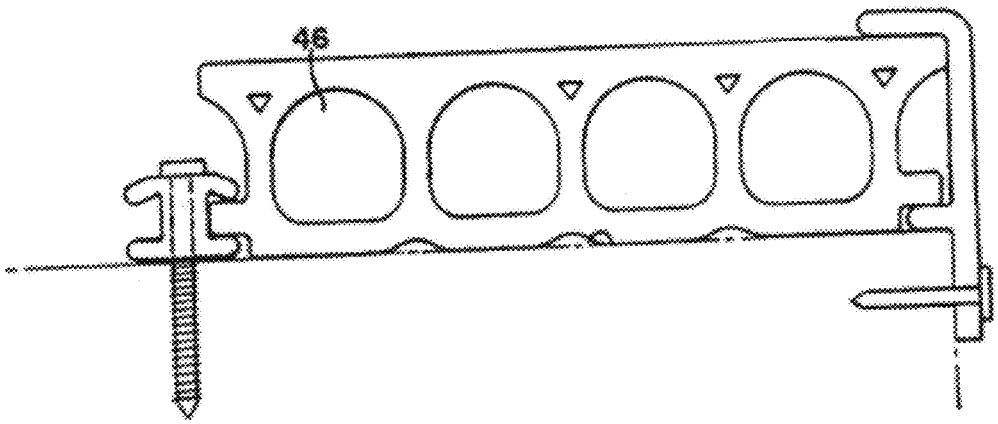
FIG. 9 shows a cross-section of a hollow profile planking unit.

With reference to the drawings, a deck board is generally indicated by reference numeral 1.

The deck board 1 includes an elongate body that has an operatively upper board section 4 that has a number of operatively downwardly depending support legs 5 extending downwardly from an underside surface 8 of the upper board section 4.

Lower ends 6 of each leg terminate in a transversely extending flanged that, in effect, forms two transversely extending flanges 7 extending transversely away from opposite sides of lower ends 6 of the legs 5.

In cross-sectional profile view, the legs, flanges and upper board section resemble I-beam sections connected side-by-side with their upper or head sections connected to each other and lower foot sections, spaced apart.

An underside surface 9 of each flange 7, is concave. Underside surfaces 8 of the upper board section 4, between the downwardly depending legs 5, are also concave. Upper surfaces 7*a* of the flanges are operatively level and, in use, receive parts of fastener clips thereon.

An upper surface 2 of the upper board section 4 includes anti-slip formations in the form of a series of parallel and elongate grooves, parallel with the main axis of the deck board 1. It will be appreciated by those skilled in the art that any other convenient anti-slip formations may be formed on the upper surface, as may be required.

The deck board 1 is extruded from a wood plastic composite material. The thickness of the board profile is at least 4 mm (0.15 inches) thick, but a minimum of 7 mm (0.27 inches) thickness is more suitable. At a thickness of less than 7 mm, the brittleness of the composite is so low that the product becomes unusable.

In use, deck boards are placed side-by-side on joists of a substructure on which an outdoor deck is to be formed. The deck boards are attached with fastener clips as is known in the art. Wings or other parts of the fastener clips locate on part of the upper surfaces 7*a* of flanges at opposite outer edges of the deck board.

This invention thus provides a deck board comprising an elongate body which, in cross section, has a number of substantially I-beam shaped sections with operatively horizontal upper or head sections connected to each other and lower operatively horizontally extending foot sections being shorter in length than the head sections so that their free ends 10 are spaced apart. Space between two free ends 10 may form an opening of a channel 11. The channel 11 may be bounded by the upper board section 4 at a top, the free ends 10 at a bottom, and the legs 5 at the sides.

A central connecting section of the I-beam connects the upper and lower sections to complete the I-beam shape. An underside of the foot section is concave. An underside of the connected head sections is concave. Upper surfaces of the foot sections are substantially operatively horizontal.

All corners and edges of the board are rounded and the arched surfaces (8 and 9) adds to the strength of the board and ensures improved load distribution. The spaced apart flanges ensure that water will easily be drained from the board. Even if water collects on the level surfaces 7*a*, and especially those at the opposite outer edges of the deck board, these surfaces are exposed and will dry relatively quickly. Water will thus not collect, or not collect for an undesired length of time, on or in the board, thereby enhancing its durability. The board is relatively light, as a result of using less material than a solid board. The board, however, remains strong enough and fit for purpose.

It will be appreciated by those skilled in the art that many other embodiments are possible without departing from the scope of the invention. For example, the board can be manufactured from any material suitable for extrusion. The board may also be used for outdoor decking, indoor floors or covering wall surfaces.

It is envisaged that the invention herein described is convenient to use in that the decking board does not include any cavities or grooves in which water will be trapped. This makes the board suitable to use for outdoor decking. Furthermore, the profile of the deck board increases load bearing capabilities of the board. The concavity of the underside of the upper head sections of the board optimises material usage with respect to product performance. Where the top element gets thicker, near to the downward leg, it transfers ordinary loading more efficiently.

The invention claimed is:

1. A deck board comprising an operatively upper board section having downwardly depending support legs, each downwardly depending support leg terminating in two flanges that extend transversely away from opposite sides of a lower end of the leg, an underside of the two flanges comprising a concave surface, an upper surface of the two flanges comprising a flat or non-concave surface, and wherein an underside surface of the upper board section links two consecutive flanges belonging to two consecutive downwardly depending support legs, the underside surface of the upper board section comprising a concave surface, the deck board being manufactured from a composite material.

2. The deck board of claim 1, wherein anti-slip formations are located in or on an upper surface of the upper board section.

3. The deck board of claim 2, wherein the anti-slip formations comprise parallel, elongate grooves or parallel elongate protrusions.

4. The deck board of claim 1, wherein the composite material is a filled thermoplastic polymer material.

5. The deck board of claim 4, wherein the composite material is a wood plastic composite material.

6. The deck board of claim 5, wherein the deck board is extruded from the wood plastic composite material.

7. The deck board of claim 1, wherein the deck board is an outdoor deck board.

8. The deck board of claim 1, wherein the deck board has a wall thickness of at least 4 mm.

9. A deck board comprising an elongate body which, in cross section, comprises a number of substantially I-beam shaped sections with operatively horizontal upper or head sections connected to one another and lower operatively horizontally extending foot sections being shorter in length than the head sections so that free ends of the foot sections are spaced apart, wherein the underside of the foot sections is concave, the foot sections comprising flanges connected to downwardly depending support legs, an underside surface of the upper or head sections linking two consecutive flanges belonging to two consecutive downwardly depending support legs, an underside surface of the upper or head sections is concave, an upper surface of the foot sections comprising a flat or non-concave surface, and wherein an the deck board being manufactured from a composite material.

10. The deck board of claim 9, wherein the downwardly depending support legs belong to a central connecting section of the I-beam that connects the upper and lower sections to complete the I-beam shape.

11. The deck board of claim 9, wherein the upper surfaces of the foot sections are substantially operatively horizontal.

12. The deck board of claim 11, wherein the composite material is a wood plastic composite material.

13. The deck board of claim 12, wherein the deck board is extruded from a wood plastic composite material.

14. The deck board of claim 9, wherein the composite material is a filled thermoplastic polymer material.

15. The deck board of claim 9, wherein the deck board is an outdoor deck board.

16. The deck board of claim 9, wherein the deck board has a wall thickness of at least 4 mm.

* * * * *